US006095042A

United States Patent [19]

Jakobsen et al.

[11] Patent Number: 6,095,042

[45] Date of Patent: Aug. 1, 2000

[54] DAMPENER ACTIVATION APPARATUS AND METHOD

[75] Inventors: James W. Jakobsen, Bergenfield, N.J.; Carlito Crespo, Spring Valley, N.Y.; Thomas Hayes, Clark, N.J.

[73] Assignee: Varn Products Company, Inc., Oakland, N.J.

[21] Appl. No.: 09/116,269

[22] Filed: Jul. 16, 1998

[51] Int. Cl.[7] ..... B41F 7/26

[52] U.S. Cl. ..... 101/148

[58] Field of Search ..... 101/147, 148, 101/349.1, 350.1, 351.1, 351.2, 351.4, 352.01, 352.02, 352.03, 352.04, 352.05, 355, 356, 357, 358, 360, 361, 362

[56] References Cited

U.S. PATENT DOCUMENTS 4,455,938 6/1984 Loudon ..... 101/148

5,551,338 9/1996 Wall et al. ..... 101/148

*Primary Examiner*—Ren Yan

*Attorney, Agent, or Firm*—Cummings & Lockwood

[57] ABSTRACT

A dampener activation apparatus is disclosed for engaging and disengaging a dampener with a plate cylinder of a printing press and for engaging and disengaging a drive gear with a roller in the dampener. The drive gear is driven to rotate about a shaft supporting the roller by a press drive train. The drive gear is also axially moveable on the shaft to engage and disengage the form roller. A first actuator is mounted to a dampener side frame and configured to translate the drive gear on the shaft to engage and disengage the form roller. A second actuator is attached to the printing press and configured to engage and disengage the dampener with the plate cylinder. A compressed air supply is in fluid communication with and configured to control the first and second actuators.

25 Claims, 7 Drawing Sheets

89
28
102
34
144
128
150
136
120
89
108
94
32
102
118
106
116
98
112
104
110
92
114
90
96
100
88
44
42
130
131
131
130
152
131
130
131
122

150
122
28
128
89
114
144
112
130
106
116
131
120
88
89
132
131
106
116
112
130
114
44
42
131

DAMPENER ACTIVATION APPARATUS AND METHOD

BACKGROUND OF THE INVENTION

1. Field of the Invention

The subject invention relates generally to lithographic printing presses and more particularly to an apparatus and method for systematically engaging and disengaging the drive gear of a dampener with the gear train of a printing press and engaging and disengaging the dampener with a plate cylinder in the printing press.

2. Background of the Related Art

On a printing press utilizing the off-set lithographic method of printing there is typically required a dampener for applying dampening solution to a printing plate for ensuring that the non-image area of the plate, and consequently the non-image area of the printed sheet, is kept clear of ink. The dampener requires an actuation mechanism for moving it toward the printing plate to engage the dampener rollers with the plate, thereby enabling the application of dampening solution to the plate, and for moving the dampener away from the printing plate when it is not required for printing. Typically, pneumatic cylinders are employed in the actuation mechanism to engage and disengage the dampener with the printing plate.

An example of a dampener used on a printing press which may utilize an actuation mechanism as described above is that disclosed in U.S. Pat. No. 4,455,938 (the '938 patent) to J. Loudon entitled DAMPENING APPARATUS FOR LITHOGRAPHIC PRESS, the disclosure of which is incorporated by reference. The apparatus described in the '938 patent essentially includes a form roller, a metering roller, and a set of side frames for supporting the rollers. The form roller engages the printing plate for dampening. The rollers are rotated by a gear train of the printing press at a predetermined rotational velocity ratio.

Dampeners may also include a mechanism for engaging and disengaging the printing press gear train from the dampener rollers. This permits the press operator to rotate the printing press cylinders and rollers without rotating the dampener rollers. Among the benefits are reduced component wear and reduced need for maintenance to the dampener. An example of a gear disengaging mechanism for a dampener is disclosed in U.S. Pat. No. 5,551,338 (the '338 patent) to R. Wall et al entitled DRIVE DISENGAGING DEVICE FOR AN OFFSET LITHOGRAPHIC SEAL-TYPE DAMPENING SYSTEM, the disclosure of which is incorporated by reference. A disadvantage of the apparatus described in the '338 patent is it must be manually engaged or disengaged by the press operator, thereby adding additional steps to the printing process. Also, the operator must physically go to each printing head of a multi-head press, as described herein below, to engage or disengage the gear drive before each printing operation. In addition, because the apparatus of the '338 patent does not function in cooperation with existing automated printing functions on the printing press, it is possible, for example, that the operator will engage the dampener while the printing press cylinders and rollers are rotating. Doing so will subject the gear train and dampener to destructive shock loads.

To more fully appreciate the advancement in the art provided by the invention disclosed herein below it is important to note that printing presses very often include several printing heads. A large 'multi-head' press can be, for example, well over 30 feet long. Each printing head incorporates the same basic components necessary to print one color of ink, namely, an inking system, a dampener, a blanket cylinder, and a plate cylinder onto which the printing plate is attached. The choice of which printing head(s) to activate for the printing operation is dependent on the number of colors needed and the type of job on the press. It is therefore economical for the operator to have the ability to remotely control the operation of each printing head component such as, for example, the dampener via the dampener actuation mechanism and the gear drive actuation mechanism disclosed and claimed herein below.

SUMMARY OF THE INVENTION

The subject invention is directed to a dampening system for a printing press having a plate cylinder and a gear drive train. A preferred embodiment of the dampening system includes a dampener moveable between a first dampener position, where the dampener is disengaged from the plate cylinder, and a second dampener position, where the dampener is engaged with the plate cylinder.

The dampener includes a first and second side frame. The first side frame is mounted adjacent the gear drive train. A form roller is supported by a shaft that is mounted to the side frames. The roller is rotatable in relation to the side frames. A metering roller is supported by a shaft that is mounted to the side frames. The metering roller is also rotatable in relation to the side frames. The metering roller is in parallel contiguous relation with the form roller.

A drive gear is configured to be drivingly rotated by the gear drive train about a gear shaft, which is defined by either the shaft supporting the form roller or the shaft supporting the metering roller—depending on the dampener configuration. The drive gear is also axially moveable on the gear shaft between a first gear position and a second gear position. A spring is interposed between the drive shaft and the drive gear so to bias the drive gear toward the first gear position. A first coupling portion depends from the drive gear. A second coupling portion depends from the driven roller, defined as the roller corresponding to the gear shaft noted above. The second coupling portion is configured to engage with the first coupling portion when the drive gear is in the second gear position and configured to disengaged from the first coupling portion when the drive gear is in the first gear position. The coupling portions may be formed as engagable raised keys depending from the drive gear and the driven roller.

A first actuator is operatively associated with the first side frame and adapted and configured to translate the drive gear between the first and second gear positions. A second actuator is operatively associated with the printing press and adapted and configured to move the dampener between the first and second dampener positions. A compressed air supply is in fluid communication with and configured to control the first and second actuators.

A preferred embodiment control system for the first and second actuators includes a coupling-engaging valve which provides fluid communication between the compressed air supply and the first actuator for activating the first actuator to move the drive gear between the first and second gear positions. In addition, a dampener-engaging valve provides fluid communication between the compressed air supply and the second actuator for activating the second actuator to move the dampener between the first and second dampener positions. A dampener-on valve is also included providing fluid communication between the compressed air supply and the dampener-engaging valve for switching the dampener-engaging valve to activate the second actuator, thereby moving the dampener from the first dampener position to the second dampener position. And a dampener-selector valve providing fluid communication between the compressed air supply and the coupling-engaging valve and the dampener-engaging valve for switching the coupling-engaging valve to activate the first actuator and for switching the dampener-engaging valve to activate the second actuator.

A dampener-off valve is also included providing fluid communication between the compressed air supply and the dampener-engaging valve for switching the dampener-engaging valve to activate the second actuator to move the dampener from the second dampener position to the first dampener position.

In addition, the control system includes a run-signal valve for preventing the coupling-engaging valve from activating the first actuator to move the drive gear from the first gear position to the second gear position and for preventing the dampener-engaging valve from activating the second actuator to move the dampener from the first dampener position to the second dampener position when the run-signal valve receives a signal indicating forward rotation of the gear drive train.

Also included is a reversing-signal valve that provides for switching the coupling-engaging valve to activate the first actuator to move the drive gear from the second gear position to the first gear position and for switching the dampening-engaging valve to activate the second actuator to move the dampener from the second dampener position to the first dampener position when the reversing-signal valve receives a signal indicating reverse rotation of the gear drive train.

Further features of the dampener actuation apparatus and method of the subject invention will become more readily apparent from the following detailed description taken in conjunction with the drawings.

BRIEF DESCRIPTION OF THE DRAWINGS

So that those of ordinary skill in the art to which the subject invention appertains will more readily understand how to make and use the dampener activation apparatus and method described herein, preferred embodiments of the invention will be described in detail herein below with reference to the drawings wherein.

DETAILED DESCRIPTION OF THE PREFERRED EMBODIMENTS

Figure 1:
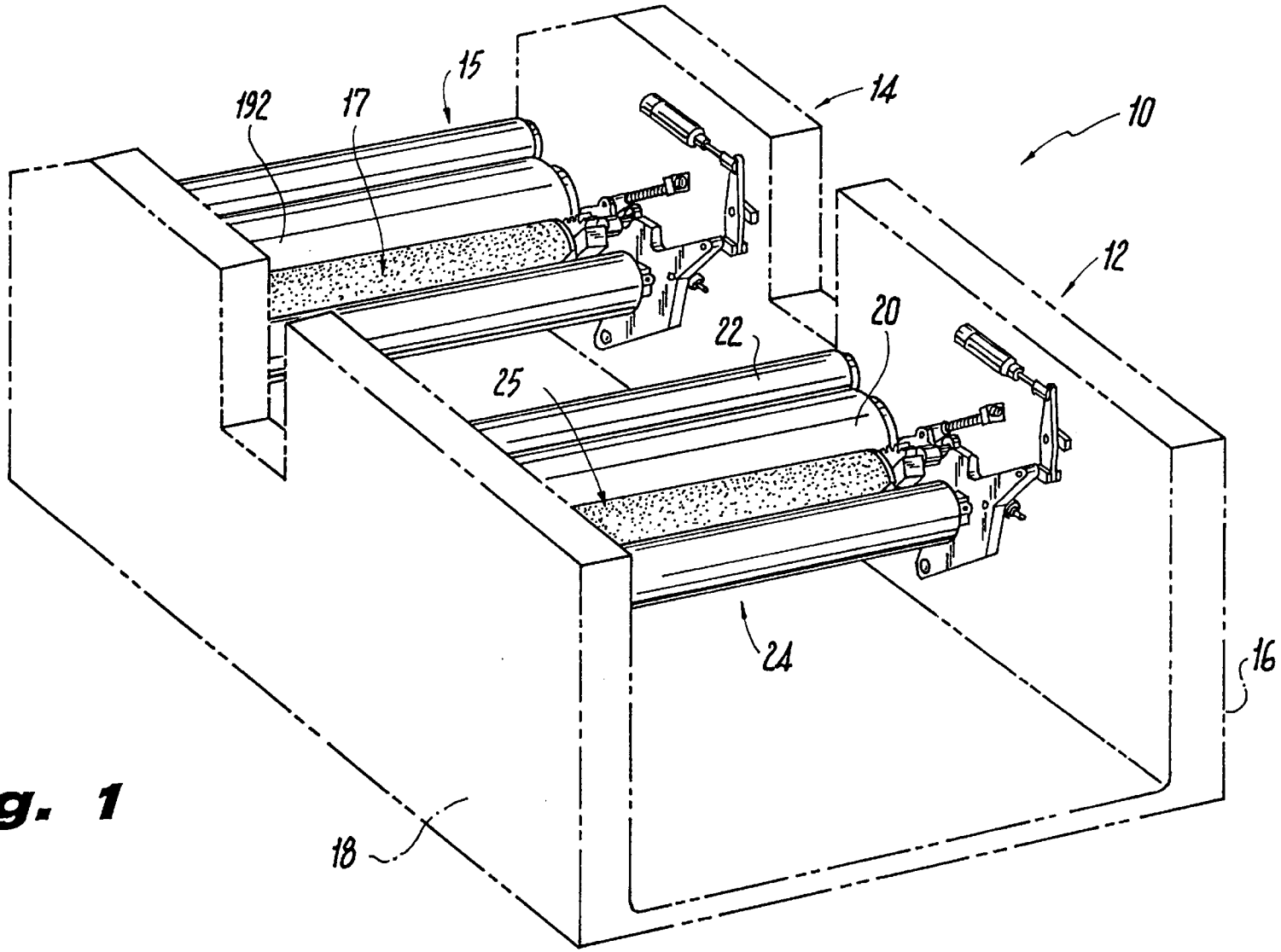
FIG. 1 is a perspective view of a printing press including dampening systems made in accordance with a preferred embodiment of the subject invention.

Referring now to the drawings wherein like reference numerals identify similar structural elements of the subject invention, there is illustrated in FIG. 1 a printing press designated generally by 10. Printing press 10 is of the type used for offset lithographic printing and is shown greatly simplified to ease in illustrating the relationship between a printing press and the present invention. Various essential components of the printing press, e.g., blanket cylinders, impression cylinders, inking rollers, ink roller hangers, paper handling mechanisms, etc., have not been shown to facilitate describing the subject invention. The printing press 10 includes a first and second printing head, 12 and 14 respectively, each capable of printing a different ink color and pattern.

First printing head 12, which is representative of each of the two printing heads, includes a set of side frames 16 and 18, a plate cylinder 20, an ink form roller 22, and a dampening system 24. The dampening system 24 incorporates a dampener 25 and an activation apparatus constructed in accordance with a preferred embodiment of subject invention. Although the description below concentrates on the dampening system 24 attached to the first printing head 12 of printing press 10, it applies equally to a dampening system 15 on the second printing head 14. And like first head dampening system 24, second head dampening system 15 incorporates a dampener 17 and an activation apparatus constructed in accordance with a preferred embodiment of subject invention. For descriptive purposes, a distinction is made between the terms 'dampening system' and 'dampener'. While the term dampener includes the basic components for dampening such as rollers, side frames, and related components therefor, the term dampening system includes the dampener plus drive gearing for rotating the rollers and dampener and gear actuation components. Note that side frame 18 is also known as the operator-side frame and, as the name suggests, is the side from which the operator runs the printing press. Side frame 16 is also known as the gear-side frame and, as the name suggests, is the side frame to which a gear train (not shown) is mounted for driving the cylinders, rollers, and various other mechanisms of printing press 10. And in a similar vein, references made herein below to the "operator-side" or the "gear-side" are in reference to those components related to or near that particular side of the printing press.

Figure 2:
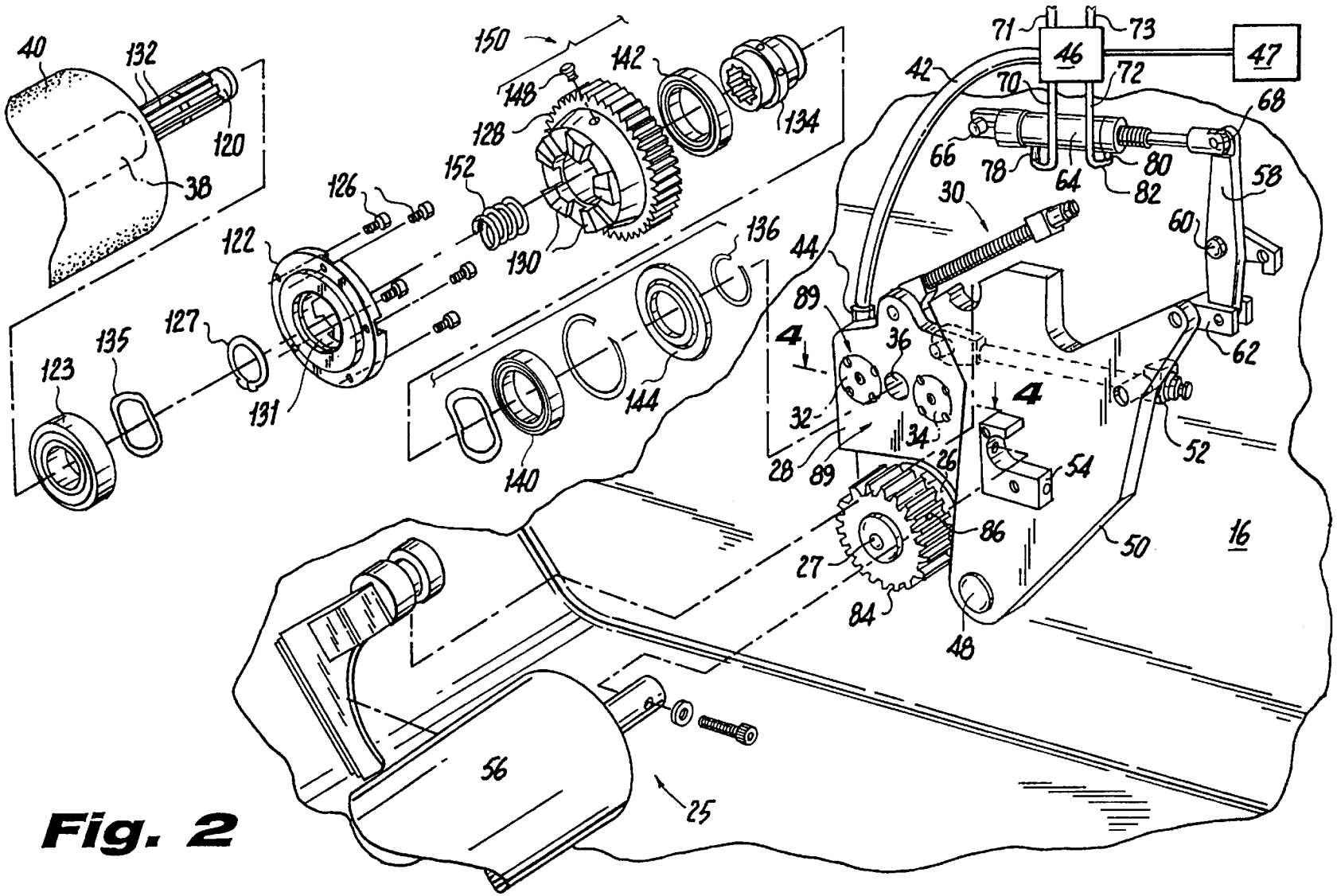
FIG. 2 is a perspective view of a dampening system made in accordance with a preferred embodiment of subject invention with selected component parts thereof separated from one another to assist in better understanding the invention.

Referring now to FIG. 2, dampening system 24 is illustrated in perspective view with various parts separated to facilitate the detailed description of the preferred embodiment that follows. Except for the various components that will be described below for engaging the dampener rollers for rotation, the dampener components on the operator-side of printing press 10 are identical to or are a mirror image of those on the gear-side of the press, therefore they will not be separately described.

With continued reference to FIG. 2, a bearing housing 26 is mounted to the gear-side frame 16 of printing press 10. Extending through bearing housing 26 is a drive shaft 27 which is driven by the press's gear train (not shown) through gears found on the far side of gear-side frame 16. A main side frame 28 is pivotally mounted to the bearing housing 26 and made adjustable to gear-side frame 16 with a first threaded adjustment mechanism 30. Main side frame 28 includes two machined cylinders 32 and 34 between which is a machined bore 36. A shaft 38 supports a form roller 40. A stepped shoulder 120 of shaft 38 fits into machined bore 36. The first end of a tube 42 is in fluid communication with main side frame cylinders 32 and 34 via a connector 44 and conduits (described below) formed in main side frame 28. The second end of tube 42 is in fluid communication with a pneumatic logic system 46, the function of which will be described in more detail below. A compressed air supply 47 is in fluid communication with and supplies pressurized air to pneumatic logic system 46. A pin 48 is pressed into a hole bored into main side frame 28.

A metering roller plate 50 is pivotally mounted on pin 48 and made adjustable to main side frame 28 with a second threaded adjustment mechanism 52. Attached to metering roller plate 50 is a hanger 54 which supports the shaft of metering roller 56.

A pivot bar 58 is pivotally mounted to gear-side frame 16 with a shoulder bolt 60 and is joined at its lower end to metering roller plate 50 with a linking bar 62. A double acting pneumatic actuator 64 is pivotally mounted by its one end to gear-side frame 16 with a shoulder bolt 66 and pivotally mounted to the upper portion of pivot bar 58 with a pin 68. Tubes 70 and 72 are in fluid communication by their first ends to gear-side dampener actuator 64 through elbow connectors 78 and 80. Between elbow 80 and tube 72 is a flow control valve 82. Tubes 70 and 72 are in fluid communication by their second ends with pneumatic logic system 46. Tubes 71 and 73 provide fluid communication between the operator-side dampener actuator (not shown) and pneumatic logic system 46 in a similar manner. A transfer gear 84 is fixedly mounted to drive shaft 27 with a set screw 86.

During printing operations, the press operator engages dampener 25, more specifically form roller 40, to plate cylinder 20 by activating the pneumatic logic system 46 to supply air pressure to tubes 70 and 71. Thereafter, with continuing reference to the gear-side components only, pneumatic actuator 64 extends and rotates pivot bar 58 about shoulder bolt 60. Through linking bar 62, pivot bar 58 rotates metering roller plate 50 and main side frame 28 about bearing housing 26 until form roller 40 contacts plate cylinder 20. The stripe, or squeeze, between form roller 40 and plate cylinder 20 is adjusted by adjusting first threaded adjustment mechanism 30 between gear-side frame 16 and main side frame 28. Because both the gear-side and operator-side dampener side frames are essentially the same, the entire dampener 25 is rotated from the off position to the on position simultaneously.

Referring now to both FIGS. 2 and 4, there are two identical pneumatic actuators that collectively are identified herein below as coupling-engaging actuators 89 and of which one will be described in detail below. Conduit 88 is machined into main side frame 28 providing an air channel between connector 44 and machined cylinders 32 and 34. Reference will be made for convenience hereinafter to the coupling-engaging actuator 89 of machined cylinder 32. A cylinder sleeve 90, preferably made of aluminum and then TEFLON coated, is slip-fit into machined cylinder 32. An O-ring 92 is received in a groove 94, formed in machined cylinder 32, for preventing leakage between machined cylinder 32 and sleeve 90. A cylinder cap 96 having a through-hole 98 concentric therewith is received in a counter-bore 100 and secured in place with screws 102. A bushing 104 is press-fit in through-hole 98. A piston 106, shown in the retracted position, is reciprocally received within cylinder sleeve 90. Piston 106 includes a groove 108 within which an O-ring 110 is seated, preventing leakage between piston 106 and cylinder sleeve 90. A rod 112 is swaged to piston 106 and extends through bushing 104. A spring spacer 116 is mounted on rod 112. A spring 114, guided by spring spacer 116 and a groove 118 formed in cylinder cap 96, biases the piston 106 and rod 112 into the retracted position.

Figure 3:
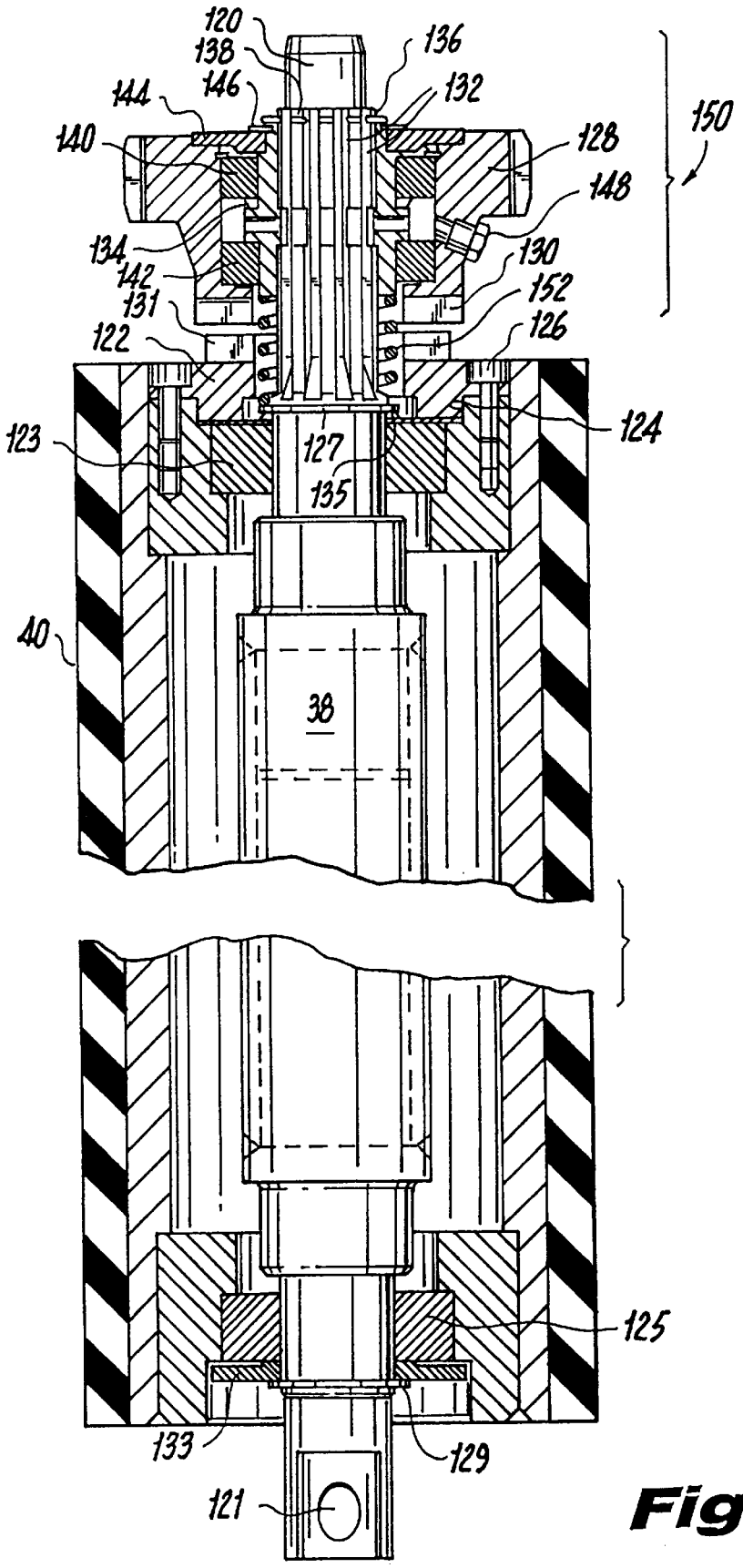
FIG. 3 is a cross-sectional view of a dampener form roller and a gear/collar assembly illustrating the relationship between the components of each when the gear/collar assembly is in a disengaged position.
Figure 4:
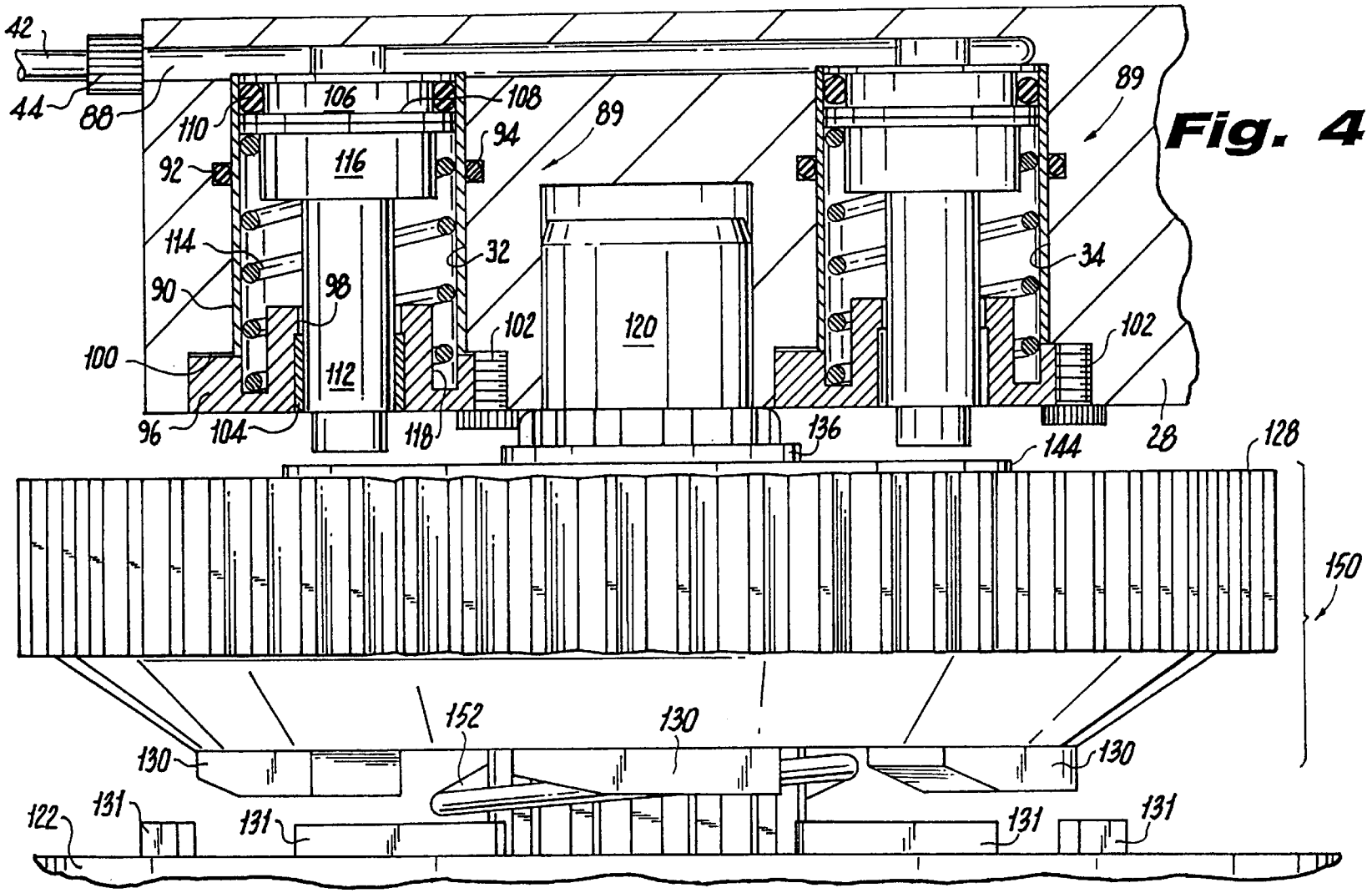
FIG. 4 is a cross-sectional view taken along line 4—4 of the dampener illustrated in FIG. 2 illustrating the relationship between a pair of coupling/engaging actuators, a gear/collar assembly, and a dampener form roller when the actuators are in a retracted position.

Referring now to FIGS. 2, 3, and 4, as noted above, stepped shoulder 120 of form roller shaft 38 fits into machined bore 36 of main side frame 28 for support. The operator-side end of shaft 38 is bolted to the operator-side main side frame (not shown) through mounting hole 121, thereby preventing rotation thereof. Form roller 40 is mounted to rotate about shaft 38 on bearings 123 and 125 which are maintained in position with retaining rings 127 and 129, a spacer 133, and wave washer 135 in a manner well known in the art. A drive disk 122 is seated in a counter-bore 124 in the end of form roller 40 and secured in place with several screws 126. Drive disk 122 is configured to drivingly engage with a drive gear 128 through a coupling. The coupling can take a variety of forms such as, for example, raised keys 130 and 131 as illustrated.

Form roller shaft 38 includes external splines 132 with which a splined collar 134 mates. A retaining ring 136 is seated in a circumferencial groove 138 formed in external splines 132 adjacent stepped shoulder 120. Drive gear 128 is mounted to rotate about splined collar 134 on bearings 140 and 142. Bearings 140 and 142 are maintained in position with a retaining ring and wave washer in a manner well known in the art. A thrust washer 144 is seated on a shoulder of splined collar 134 and kept in place with a retaining ring 146. Thrust washer 144 clears drive gear 128 and therefore does not rotate therewith. A grease fitting 148 is threaded into a tapered shoulder of drive gear 128 permiting lubrication of the splined areas of 132 and 134. The portion of drive gear 128 adjacent form roller 40 includes the raised keys 130 that mate with and drivingly engage the raised keys 131 of drive disk 122. Each key of raised keys 130 and 131 include a helically shaped chamfer opposite its driving edge which allows smooth drive gear 128 to drive disk 122 engagement. The parts described immediately above are collectively called a gear/collar assembly 150.

With form roller shaft 38 mounted to the gear-side main side frame 28 and the operator-side main side frame (not shown), and the drive gear 128 mounted to the shaft 38 as described above, drive gear 128 constantly meshes with and is driven by transfer gear 84. A coil spring 152 fits between retaining ring 127 and an end face of splined collar 134, thereby biasing gear/collar assembly 150 against retaining ring 136. This position is identified hereinafter as the 'first gear position'. When raised keys 130 and 131 of the drive gear 128 and the drive disk 122, respectively, are engaged, that position is identified hereinafter as the 'second gear position'.

Figure 5:
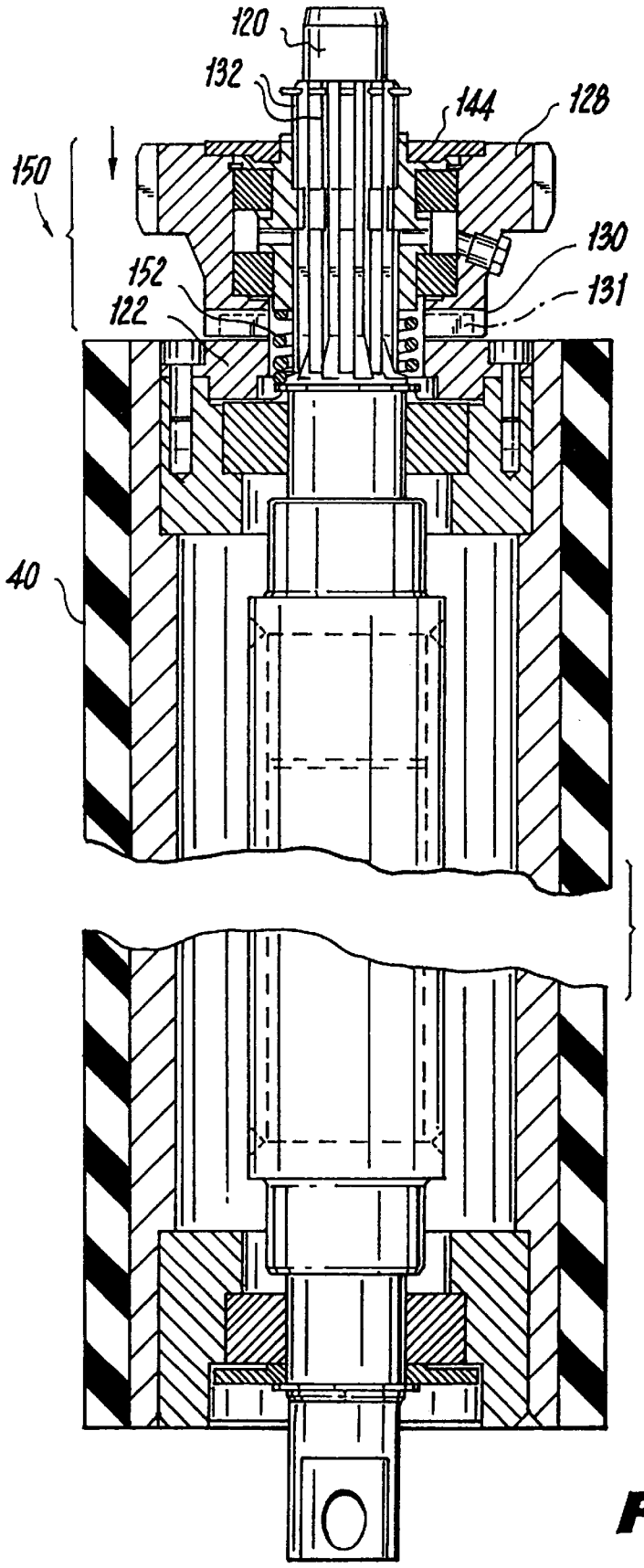
FIG. 5 is a cross-sectional view of a dampener form roller and a gear/collar assembly similar to FIG. 3 illustrating the relationship between the components of each when the gear/collar assembly is in an engaged position.
Figure 6:
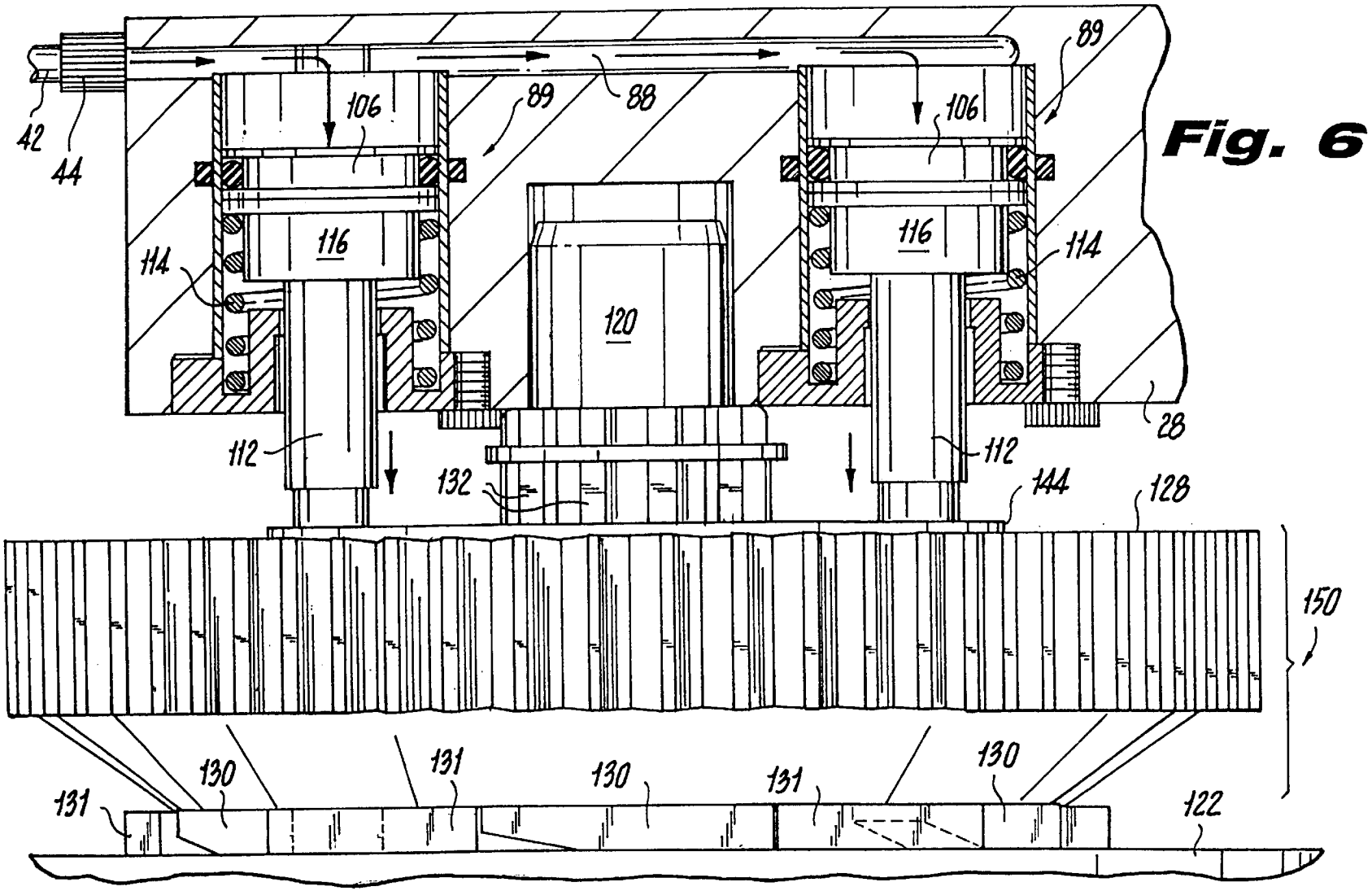
FIG. 6 is a cross-sectional view similar to FIG. 4 illustrating the relationship between a pair of coupling/engaging actuators, a gear/collar assembly, and a dampener form roller when the actuators are in an extended position.

Referring now to FIGS. 2, 5, and 6, to engage drive gear 128 with drive disk 122, air pressure is directed by pneumatic logic system 46, through tube 42 to main side frame 28. Thereafter, coupling-engaging actuators 89 extend to contact thrust washer 144, forcing the gear/collar assembly 150 to translate axially on spline 132 to the second gear position. In the second gear position, raised keys 130 of drive gear 128 fully engage raised keys 131 of drive disk 122. If raised keys 130 and 131 are not initially aligned for full engagement when coupling-engaging actuators 89 are first activated, they fully engage within one-fifth rotation of drive gear 128.

Figure 7:
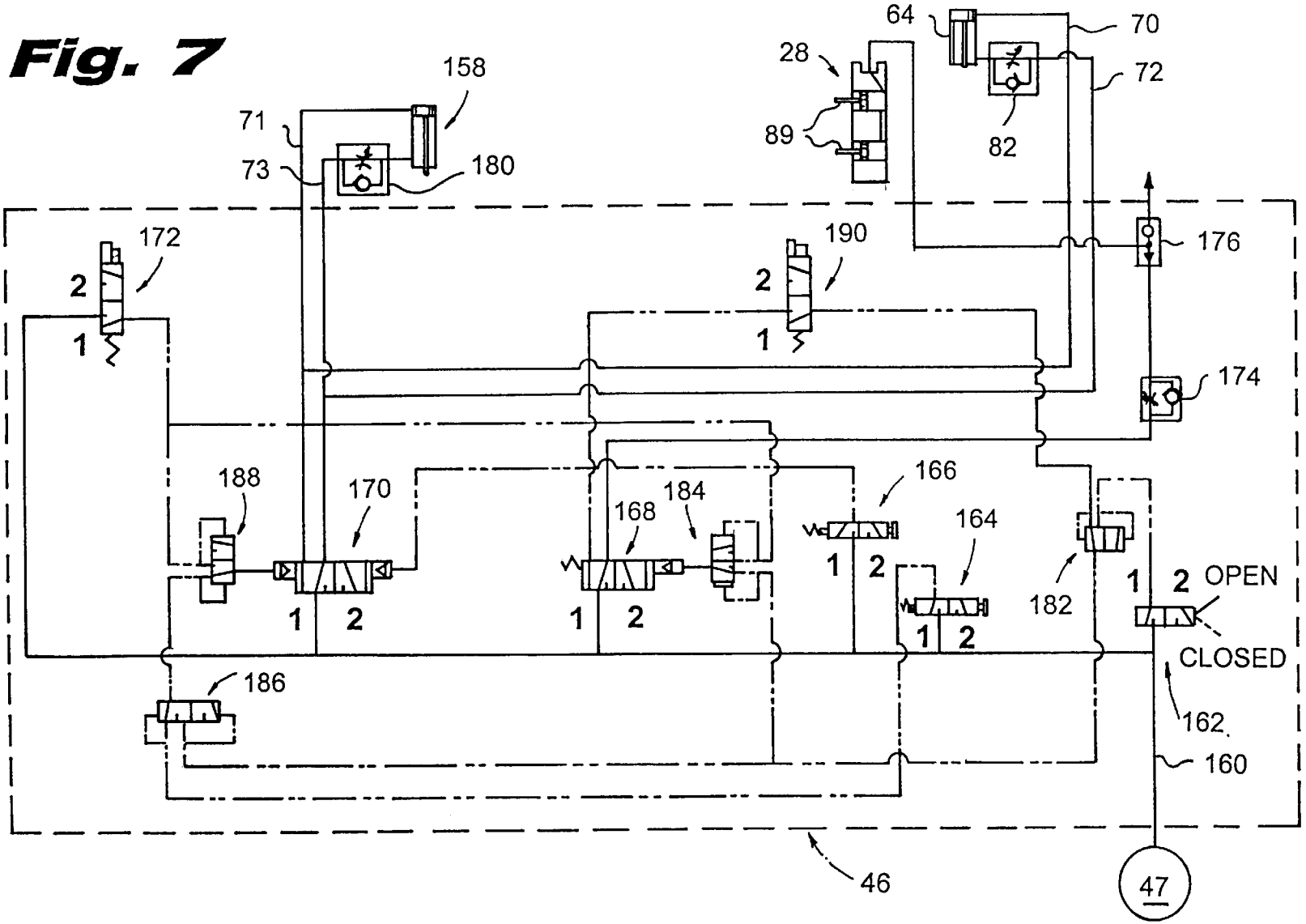
FIG. 7 is a schematic view of a preferred embodiment of a pneumatic logic system and components from a dampener and printing press that interface therewith.

Referring now to FIG. 7 there is illustrated a schematic of pneumatic logic system 46 for coordinating the operation of printing press 10, gear-side dampener actuator 64 and operator-side dampener actuator 158, and coupling-engaging actuators 89. Also illustrated in FIG. 7 is compressed air supply 47 which typically provides approximately 6.2 bar (90 p.s.i.g.). Most larger printing presses are provided with compressors (not shown) which store compressed air in a volume tank when the press is energized. Alternately, press operators can use compressed air from a shop compressor. Note that the description provided below indicating how logic system 46 functions with first dampener 25 applies equally to the logic system and dampener installed on second printing head 14 of printing press 10.

Referring to FIGS. 4, 6, and 7, pneumatic logic system 46 enables three basic modes of operation. In mode one, coupling-engaging actuators 89 are retracted so drive gear 128 is biased by spring 152 to the first gear position (ref. FIG. 4) and dampener actuators 64 and 158 are retracted so dampener 25 is disengaged from plate cylinder 20. In mode two, coupling-engaging actuators 89 are extended so drive gear 128 is in the second gear position (ref. FIG. 6) and dampener actuators 64 and 158 are retracted so dampener 25 is disengaged from plate cylinder 20. And in mode three, coupling-engaging actuators 89 are extended so drive gear 128 is located in the second gear position (again, ref. FIG. 6) and dampener actuators 64 and 158 are extended so dampener 25 is engaged with plate cylinder 20.

In FIG. 7, all of the components illustrated are positioned as they would be with logic system 46 in mode two and air pressure is supplied by compressed air supply 47 to a main conduit 160. Having compressed air supplied to the printing press is typical during press operations in that other functions of the printing press (e.g., ink roller actuation) rely on it. For the descriptions that follow assume that main conduit 160 is always pressurized. Also note in FIG. 7 that each valve position of the three-way and four-way type valves are identified as valve-position one (1) and valve-position two (2) to assist in describing logic system 46. When logic system 46 is in mode two, all valves are in valve-position one (1).

With particular reference to FIG. 7, compressed air supply 47 provides pressurized air directly to a dampener-selector valve 162, a dampener-off valve 164, a dampener-on valve 166, a coupling-engaging valve 168, a dampener-engaging valve 170, and a reversing-signal valve 172. As noted above, FIG. 7 illustrates logic system 46 in mode two. While in mode two, pressurized air is fed through coupling-engaging valve 168 to coupling-engaging actuators 89, thereby extending pistons 106. A flow control valve 174 is provided between valve 168 and actuators 89 for regulating the engagement speed of gear/collar assembly 150 with form roller 40. A quick exhaust valve 176 is also provided between valve 168 and actuators 89 for rapidly evacuating the air pressure from coupling engaging actuators 89 when the air pressure is removed as will be described herein below.

In mode two, pressurized air is also fed through dampener-engaging valve 170 to gear-side dampener actuator 64 and operator-side dampener actuator 158 for retracting the actuators and disengaging dampener 25 from plate cylinder 20. Flow control valves 82 and 180 are provided between valve 170 and actuators 64 and 158, respectively, for regulating the extension speed of the actuators and, therefore, the engagement speed of dampener 25 with plate cylinder 20 as will be described herein below.

There are two circumstances when logic system 46 is in mode one. First, when dampener-selector valve 162 is switched to the 'closed' position, valve-position two (2), pressurized air is fed through dampener-selector valve 162 activating a first shuttle valve 182 that activates a second shuttle valve 184 which, thereafter, switches coupling-engaging valve 168 to valve-position two (2). Coupling-engaging valve 168 initiates venting of coupling-engaging actuators 89 and enables quick exhaust valve 176 to rapidly vent air therefrom. As described above, retraction of coupling-engaging actuators 89 allows gear/collar assembly 150 to disengage from drive disk 122 by moving from the second gear position (ref. FIG. 6) to the first gear position (ref. FIG. 4). Also sequentially activated by first shuttle valve 182 is a third shuttle valve 186 that activates a forth shuttle valve 188 which thereafter switches dampener-engaging valve 170 to valve-position one (1) (if valve 170 is not already in valve-position one (1)). When dampener-engaging valve 170 is in valve-position one (1), pressurized air is fed to gear-side dampener actuator 64 and operator-side dampener actuator 158 for retracting both actuators and disengaging dampener 25 from plate cylinder 20.

A run-signal valve 190 is included in logic system 46 to retain the system in mode one after the dampener-selector valve 162 is switched to the 'closed' position, valve-position two (2), and the printing press cylinders and rollers are rotating in the forward direction as when, for example, the operator is printing. Note that when the cylinders and rollers of printing press 10 are rotating, the gear drive train, and thereby, drive gear 128, is also rotating. Including run-signal valve 190 in the logic system 46 is advantageous for when the printing press cylinders and rollers are rotating and the dampener rollers are stationary since it prevents the operator from engaging rotating drive gear 128 with a stationary form roller 40. If logic system 46 were to permit engagement under such circumstances, severe damage to the drive train would likely result.

As described above, when dampener-selector valve 162 is switched to the 'closed' position, valve-position two (2), coupling-engaging valve 168 switches to valve-position two (2). Pressurized air is fed through coupling-engaging valve 168 to run-signal valve 190. When the printing press cylinders and rollers are rotating, the printing press's electrical system (not shown) provides a signal to switch run-signal valve 190 to valve-position two (2) thereby feeding pressurized air to first shuttle valve 182. Thereafter, the operator is prevented from engaging gear/collar assembly 150 with form roller 40 or engaging dampener 25 with printing plate 20. For example, switching dampener-selector valve 162 to the 'open' position, valve-position one (1), while the cylinders and rollers are rotating forward will not switch logic system 46 from mode one to mode two because run-signal valve 190 will continue to provide pressurized air to first shuttle valve 182, thereby maintaining coupling-engaging valve 168 in valve-position two (2) and dampener-engaging valve 170 in valve-position one (1). Since run-signal valve 190 is a solenoid activated momentary type valve, it returns to valve-position one (1) when forward rotation is discontinued and, thereby, no run signal is received.

The second circumstance when logic system 46 is in mode one occurs when the printing press cylinders and rollers are rotated in the reverse direction. This occurs, for example, when the operator is clearing a paper jam. At such time, a reversing signal is received from the printing press's electrical system (not shown) which switches reversing-signal valve 172 to valve-position two (2). Pressurized air is then fed through reversing-signal valve 172 which activates second shuttle valve 184, thereafter switching coupling-engaging valve 168 to valve-position two (2). In valve-position two (2), as described above, coupling-engaging valve 168 initiates venting of coupling-engaging actuators 89 and enables quick exhaust valve 176 to rapidly vent air therefrom. Also activated by reversing-signal valve 172 is fourth shuttle valve 188 which thereafter switches dampener-engaging valve 170 to valve-position one (1). In valve-position one (1), as described above, dampener-engaging valve 170 feeds pressurized air to gear-side dampener actuator 64 and operator-side dampener actuator 158 for retracting both actuators and disengaging dampener 25 from plate cylinder 20. Since reversing-signal valve 172 is a solenoid activated momentary type valve, it returns to valve-position one (1) when reverse rotation is discontinued and, thereby, no reversing signal is received. Disengaging drive gear 128 from form roller 40 and disengaging dampener form roller 40 from plate cylinder 20 when reversing is advantageous to dampeners of the type disclosed in the '938 patent in that spillage of dampening solution from the dampening solution reservoir can be prevented by doing so. This is because reverse rotation of the metering roller and form roller tends to draw dampening solution from the reservoir between the rollers and into the printing press.

Pneumatic logic system 46 may be switched from mode two to mode three by activating dampener-on valve 166. Dampener-on valve 166 is a momentary-type valve therefore it only temporarily switches from valve-position one (1) to valve-position two (2). While in valve-position two (2) pressurized air is fed to dampener-engaging valve 170, switching valve 170 to valve-position two (2). Note that dampener-engaging valve 170 stays in valve-position two (2) until switched back again to valve-position one (1) by the activation of fourth shuttle valve 188. While in valve-position two (2), pressurized air is fed through dampener-engaging valve 170 to gear-side dampener actuator 64 and operator-side dampener actuator 158 for extending the actuators and engaging dampener 25 to plate cylinder 20. As noted above, flow control valves 82 and 180 regulate the speed with which dampener form roller 40 engages plate cylinder 20.

Pneumatic logic system 46 may be switched from mode three to mode two by activating dampener-off valve 164. Since dampener-off valve 164 is also a momentary-type valve, it only temporarily switches from valve-position one (1) to valve-position two (2). While in valve-position two (2) pressurized air is fed to third shuttle valve 186 which activates fourth shuttle valve 188 which, thereafter, switches dampener-engaging valve 170 to valve-position one (1). When dampener-engaging valve 170 is in valve-position one (1), as noted above, pressurized air is fed to gear-side dampener actuator 64 and operator-side dampener actuator 158 for retracting both actuators and disengaging dampener 25 from plate cylinder 20.

In operation, the press operator chooses which particular mode of operation to use as follows. Mode one is chosen when the operator does not want to use the particular dampener during the printing operation, e.g., during a multi-color printing job wherein there are less colors in the job than there are printing heads on the press. Mode one is set by switching dampener-selector valve 162 to the 'closed' position, valve-position two (2). Mode two is chosen when the press operator is preparing for printing operations and during dampener cleanup. With the printing press cylinders and rollers not rotating for the reason described herein above, mode two is set by switching dampener-selector valve 162 to the 'open' position, valve-position one (1). And mode three is chosen when the press operator wants to print with the particular dampener and is set by activating dampener-on valve 166 which switches dampener-engaging valve 170 to valve-position two (2).

Referring now to FIG. 1, an example of utilizing pneumatic logic systems for controlling dampeners 25 and 17 on two color printing press 10 is described herein below. In the example, a single color job is run on two color printing press 10. And, as noted above, because each dampener 25 and 17 includes its own pneumatic logic system 46 to control its operation, each dampener is engaged and disengaged independently.

When printing a single color job on two color printing press 10 the operator will typically set first printing head dampener 25 to mode one and initially set second printing head dampener 17 to mode two. After printing ink has been added to the inking system (not shown) and fountain solution has been added to second printing head dampener 17, the operator will test whether the dampener will properly "clean up" the printing plate attached to a plate cylinder 192. This is accomplished by rotating the cylinders and rollers of the printing press in the forward direction, setting second head dampening system 17 to mode three, and engaging the ink rollers with the plate on plate cylinder 192. If the results are satisfactory, the operator is ready to print by starting the printing press's paper feeder system (not shown) to deliver paper through the press.

From the above description of the preferred embodiments it is apparent that there are significant advantages in utilizing the dampener actuation apparatus and method of operation thereof. Especially notable is the ability to disconnect the dampener from the printing press's gear drive train when not needed for the particular printing operation, thereby significantly reducing wear and tear in the dampener. Also notable are the fail-safe systems that prevent the dampener from rotating in reverse and prevent actuation of the dampener when the printing press is rotating, providing great advantage over prior art systems. In addition, the invention disclosed allows the operator to activate the dampener remotely, thereby freeing him from the distraction of walking to each printing head to activate each dampener.

It is envisioned that pneumatic logic system 46 may be integrated into existing pneumatic logic systems of a printing press to various degrees so to utilize existing press functions such as, for example, automatic sequential switching from mode two to mode three when the print operation on the printing press is selected. It is also envisioned that various functions of the logic system may be accomplished by electrical or electronic control components without departing from the scope of the invention. It is further envisioned that the dampener activation apparatus can be utilized with various other types of dampeners, thereby providing the various advantages as described above.

While the invention has been described with respect to a preferred embodiment, those skilled in the art will readily appreciated that various other changes and/or modifications can be made to the invention without departing from the spirit or scope of the invention as defined by the appended claims.

What is claimed is:

1. A dampener activation apparatus for engaging and disengaging a drive gear of a dampener, the apparatus comprising:

a) a drive gear operatively configured to be drivingly rotated by a gear drive train about a shaft of the dampener and moveable between a first gear position and a second gear position;

b) a first coupling mounted to said drive gear;

c) a second coupling mounted to a roller of the dampener and configured to be engaged with said first coupling when said drive gear is in said second gear position and to be disengaged from said first coupling when said drive gear is in said first gear position;

d) an actuator in operational relation with said drive gear and adapted and configured to translate said drive gear between said first and second gear positions; and f) a compressed air supply in fluid communication with and configured to control activation of said actuator wherein air flow to said actuator is remotely actuable and controls the position of said actuator in translating said drive gear between said first gear position and said second gear position.

2. A dampener activation apparatus as recited in claim 1, further including a spring operatively associated with the shaft and said drive gear so to bias said drive gear toward said first gear position.

3. A dampener activation apparatus as recited in claim 1, wherein said first coupling and said second coupling are defined at least in part by engagable raised keys depending from said drive gear and the roller.

4. A dampener activation apparatus as recited in claim 1, wherein the shaft is fixed from rotation in relation to a side frame of the dampener and further including a collar that is splined to the shaft and operatively supporting said drive gear.

5. A dampener activation apparatus as recited in claim 4, further including a spring interposed between the shaft and said collar to bias said drive gear toward said first gear position and wherein said actuator is engagable with said collar opposing said spring bias when translating said drive gear between said first and second gear positions.

6. A dampener activation apparatus as recited in claim 1, wherein control of said actuator is effectuated by:

a coupling-engaging valve providing fluid communication between said compressed air supply and said actuator for activating said actuator to engage and disengage said drive gear with the roller; and a dampener-selector valve providing fluid communication between said compressed air supply and said coupling-engaging valve for switching said coupling-engaging valve to activate said actuator to move said drive gear from said second gear position to said first gear position.

7. A dampener activation apparatus as recited in claim 6, further including a shuttle valve providing fluid communication between said dampener-selector valve and said coupling-engaging valve and a run-signal valve providing fluid communication between said coupling-engaging valve and said shuttle valve for preventing said coupling-engaging valve from activating said actuator to move said drive gear from said first gear position to said second gear position when said run-signal valve receives a signal indicating forward rotation of the gear drive train.

8. A dampener activation apparatus for engaging and disengaging a dampener of the type including a side frame to which a roller having a shaft is rotatably mounted, with a printing press having a plate cylinder and a gear drive train, the activation apparatus comprising:

a) a drive gear operatively configured to be drivingly rotated about the shaft by the gear drive train and axially moveable between a first gear position and a second gear position;

b) a first coupling portion mounted to said drive gear;

c) a second coupling portion mounted to the roller and configured to be engaged with said first coupling portion when said drive gear is in said second gear position and to be disengaged from said first coupling portion when said drive gear is in said first gear position;

d) a first actuator operatively associated with the side frame and adapted and configured to translate said drive gear between said first gear position and said second gear position;

e) a second actuator operatively associated with said printing press and adapted and configured to move the dampener between a first dampener position where the dampener is disengaged from the plate cylinder and a second dampener position where the dampener is engaged with said plate cylinder; and f) a compressed air supply in fluid communication with and configured to control activation of said first and second actuators.

9. A dampener activation apparatus as recited in claim 8, further including a spring operatively associated with the shaft and said drive gear so to bias said drive gear toward said first gear position.

10. A dampener activation apparatus as recited in claim 8, wherein said first coupling portion and said second coupling portion are defined at least in part by engagable raised keys depending from said drive gear and the roller.

11. A dampener activation apparatus as recited in claim 8, wherein the shaft is fixed from rotation in relation to the side frame and further including a collar that is splined to the shaft and operatively supporting said drive gear.

12. A dampener activation apparatus as recited in claim 11, further including a spring operatively interposed between the shaft and said collar to bias said drive gear toward said first gear position and wherein said actuator is engagable with said collar opposing said spring bias when translating said drive gear between said first and second gear positions.

13. A dampener activation apparatus as recited in claim 8, further including:

a) a coupling-engaging valve providing fluid communication between said compressed air supply and said first actuator for activating said first actuator to move said drive gear between said first and second gear positions;

b) a dampener-engaging valve providing fluid communication between said compressed air supply and said second actuator for activating said second actuator to move the dampener between said first and second dampener positions;

c) a dampener-on valve providing fluid communication between said compressed air supply and said dampener-engaging valve for controlling switching of said dampener-engaging valve to activate said second actuator to move the dampener from said first dampener position to said second dampener position; and d) a dampener-selector valve providing fluid communication between said compressed air supply, and said coupling-engaging valve and said dampener-engaging valve for switching said coupling-engaging valve to activate said first actuator to move said drive gear from said second gear position to said first gear position and for switching said dampener-engaging valve to activate said second actuator to move the dampener from said second dampener position to said first dampener position.

14. A dampener activation apparatus as recited in claim 13, further including a dampener-off valve providing fluid communication between said compressed air supply and said dampener-engaging valve for switching said dampener-engaging valve to move the dampener from said second dampener position to said first dampener position.

15. A dampener activation apparatus as recited in claim 13, further including a shuttle valve in fluid communication between said dampener-selector valve, and said coupling-engaging valve and said dampener-engaging valve, and a run-signal valve providing fluid communication between said coupling-engaging valve and said shuttle valve for preventing said coupling-engaging valve from activating said first actuator to move said drive gear from said first gear position to said second gear position and for preventing said dampener-engaging valve from activating said second actuator from moving the dampener from said first dampener position to said second dampener position when said run-signal valve receives a signal indicating forward rotation of the gear drive train.

16. A dampener activation apparatus as recited in claim 13, further including a reversing-signal valve providing fluid communication between said compressed air supply, and said coupling-engaging valve and said dampener-engaging valve, said reversing-signal valve switching said coupling-engaging valve to activate said first actuator to move said drive gear from said second gear position to said first gear position and switching said dampener-engaging valve to activate said second actuator to move the dampener from said second dampener position to said first dampener position when said reversing-signal valve receives a signal indicating reverse rotation of the gear drive train.

17. A dampening system for a printing press having a plate cylinder and a gear drive train, said dampening system comprising:

a) a dampener moveable between a first dampener position where said dampener is disengaged from the plate cylinder and a second dampener position where said dampener is engaged with the plate cylinder, said dampener including:
   i) a side frame;
   ii) a form roller supported by a shaft mounted to said side frame and rotationable in relation to said side frame; and
   iii) a metering roller supported by a shaft mounted to said side frame, rotationable in relation to said side frame, and in parallel contiguous relation with said form roller;

b) a drive gear configured to be drivingly rotated about a gear shaft, defined as one of said form roller and metering roller shafts, by the gear drive train and axially moveable on said gear shaft between a first gear position and a second gear position;

c) a first coupling portion mounted to said drive gear;

d) a second coupling portion mounted to a driven roller, defined as one of said form and metering rollers supported by said gear shaft, and configured to be engaged with said first coupling portion when said drive gear is in said second gear position and configured to be disengaged from said first coupling portion when said drive gear is in said first gear position;

e) a first actuator operatively associated with said side frame and adapted and configured to translate said drive gear between said first and second gear positions;

f) a second actuator operatively associated with the printing press and adapted and configured to move said dampener between said first and second dampener positions; and g) a compressed air supply in fluid communication with and configured to control said first and second actuators.

18. A dampening system as recited in claim 17, further including a spring operatively associated with said gear shaft and said drive gear so to bias said drive gear toward said first gear position.

19. A dampening system as recited in claim 17, wherein said first coupling portion and said second coupling portion are defined at least in part by engagable raised keys depending from said drive gear and said driven roller.

20. A dampening system as recited in claim 17, wherein said gear shaft is fixed from rotation in relation to said side frame and further including a collar that is splined to said gear shaft and operatively supporting said drive gear.

21. A dampening system as recited in claim 20, further including a spring interposed between said gear shaft and said collar to bias said drive gear toward said first gear position and wherein said first actuator is engagable with said collar opposing said spring bias when translating said drive gear between said first and second gear positions.

22. A dampening system as recited in claim 17, wherein control of said first and second actuators is effectuated by:

a) a coupling-engaging valve providing fluid communication between said compressed air supply and said first actuator for activating said first actuator to move said drive gear between said first and second gear positions;

b) a dampener-engaging valve providing fluid communication between said compressed air supply and said second actuator for activating said second actuator to move said dampener between said first and second dampener positions;

c) a dampener-on valve providing fluid communication between said compressed air supply and said dampener-engaging valve for switching said dampener-engaging valve to activate said second actuator to move said dampener from said first dampener position to said second dampener position; and d) a dampener-selector valve providing fluid communication between said compressed air supply, and said coupling-engaging valve and said dampener-engaging valve for switching said coupling-engaging valve to activate said first actuator to move said drive gear from said second gear position to said first gear position and for switching said dampener-engaging valve to activate said second actuator to move said dampener from said second dampener position to said first dampener position.

23. A dampening system as recited in claim 22, further including a dampener-off valve providing fluid communication between said compressed air supply and said dampener-engaging valve for switching said dampener-engaging valve to activate said second actuator to move said dampener from said second dampener position to said first dampener position.

24. A dampening system as recited in claim 22, further including a shuttle valve in fluid communication between said dampener-selector valve, and said coupling-engaging valve and said dampener-engaging valve, and a run-signal valve providing fluid communication between said coupling-engaging valve and said shuttle valve for preventing said coupling-engaging valve from activating said first actuator to move said drive gear from said first gear position to said second gear position and for preventing said dampener-engaging valve from activating said second actuator to move said dampener from said first dampener position to said second dampener position when said run-signal valve receives a signal indicating forward rotation of the gear drive train.

25. A dampening system as recited in claim 22, further including a reversing-signal valve providing fluid communication between said compressed air supply, and said coupling-engaging valve and said dampening-engaging valve, said reversing-signal valve switching said coupling-engaging valve to activate said first actuator to move said drive gear from said second gear position to said first gear position and switching said dampening-engaging valve to activate said second actuator to move said dampener from said second dampener position to said first dampener position when said reversing-signal valve receives a signal indicating reverse rotation of the gear drive train.

* * * * *